US008936355B2

(12) United States Patent
Wakamatsu et al.

(10) Patent No.: US 8,936,355 B2
(45) Date of Patent: Jan. 20, 2015

(54) LIQUID EJECTING HEAD AND LIQUID EJECTING APPARATUS

(71) Applicant: Seiko Epson Corporation, Tokyo (JP)

(72) Inventors: Kosuke Wakamatsu, Chino (JP); Nobuhiro Naito, Chino (JP); Satoshi Nagatoya, Azumino (JP); Michiya Nakamura, Azumino (JP); Takeshi Yasoshima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/141,159

(22) Filed: Dec. 26, 2013

(65) Prior Publication Data

US 2014/0184705 A1 Jul. 3, 2014

(30) Foreign Application Priority Data

Dec. 27, 2012 (JP) ..... 2012-284504

(51) Int. Cl.

| | |
|---|---|
| ***B41J 2/045*** | (2006.01) |
| ***B41J 2/05*** | (2006.01) |
| ***B41J 2/14*** | (2006.01) |
| ***B41J 2/16*** | (2006.01) |

(52) U.S. Cl.

CPC ..... *B41J 2/14233* (2013.01); *B41J 2/1606* (2013.01); *B41J 2/161* (2013.01); *B41J 2/1623* (2013.01); *B41J 2/164* (2013.01); *B41J 2002/14491* (2013.01); *B41J 2202/03* (2013.01)

USPC ..... 347/68; 347/64; 347/65

(58) Field of Classification Search

None

See application file for complete search history.

(56) References Cited

U.S. PATENT DOCUMENTS

| | | | | |
|---|---|---|---|---|
| 7,686,421 | B2 * | 3/2010 | Yasoshima et al. | 347/45 |
| 2011/0234710 | A1 * | 9/2011 | Fujita et al. | 347/70 |
| 2012/0182360 | A1 | 7/2012 | Ito et al. | |

FOREIGN PATENT DOCUMENTS

| | | |
|---|---|---|
| JP | 2009-083140 | 4/2009 |
| JP | 2011-088369 | 5/2011 |
| JP | 2012-143981 | 8/2012 |

* cited by examiner

*Primary Examiner* — Geoffrey Mruk

(74) *Attorney, Agent, or Firm* — Workman Nydegger

(57) ABSTRACT

A liquid ejecting head suppresses erosion of silicon substrates by liquid, and whereby suppresses leakage of liquid, discharging failure of liquid droplets, and peeling-off of laminated substrates. The liquid ejecting head includes at least a nozzle plate on which nozzle openings for discharging liquid are provided, and a flow path formation substrate on which a pressure generation chamber communicating with the nozzle openings is provided. The nozzle plate is formed with a silicon substrate. At least the flow path formation substrate and the nozzle plate are bonded to each other after providing a tantalum oxide film formed by atomic layer deposition on the entire surfaces including a bonded surface.

8 Claims, 7 Drawing Sheets

B-B'

LIQUID EJECTING HEAD AND LIQUID EJECTING APPARATUS

BACKGROUND

1. Technical Field

The present invention relates to a liquid ejecting head which ejects liquid from nozzle openings and a liquid ejecting apparatus, particularly to an ink jet type recording head which ejects ink as liquid and an ink jet type recording apparatus.

2. Related Art

An ink jet type recording head which is an example of the liquid ejecting head, for example, includes a piezoelectric actuator which is a piezoelectric element on one surface side of a flow path formation substrate on which a pressure generation chamber which communicates with nozzle openings is provided, and ejects ink droplets from nozzles in such a manner that a vibrating plate is deformed due to the driving of the piezoelectric actuator and a change in pressure occurs in the pressure generation chamber.

Herein, there is a proposal of a vibrating plate containing silicon oxide or zirconium oxide on the flow path formation substrate side (for example, see JP-A-2009-83140 and JP-A-2011-88369).

In addition, there is proposed that a protection film having resistance to liquid of a material such as tantalum oxide is provided on an inner wall of a flow path of the pressure generation chamber or the like, for preventing erosion of the flow path formation substrate or the vibrating plate due to the ink in the flow path (for example, see JP-A-2012-143981).

However, although the protection film having resistance to liquid is provided on the inner wall of the flow path, in a configuration in which substrates formed with silicon substrates are laminated to each other, there are problems that the ink invades and erodes adhered boundary surfaces of the laminated substrates, bonding strength decreases due to reduction of adhered boundary surfaces, and malfunctions such as leakage or discharging failure of the ink and peeling-off of the laminated substrate occur.

In addition, although the protection film having resistance to liquid is provided on the inner wall of the flow path, if a pin hole or the like is formed on the protection film, the ink (liquid) in the flow path erodes the silicon substrate through the pin hole.

Further, if the pin hole is formed on the protection film which is provided on the inner wall of the flow path, there are problems that a vibrating property of the vibrating plate is negatively affected due to erosion of the vibrating plate, and there is a difficulty in stably deforming the vibrating plate.

Particularly, in order to realize high density of the nozzle openings and a thin shape of the ink jet type recording head, it is necessary to make the protection film thin, and therefore a problem of the pin hole or the like tends to occur on the protection film.

The problems described above not only occur in the inkjet type recording head, but also occur in a liquid ejecting head which ejects liquid other than the ink.

SUMMARY

An advantage of some aspects of the invention is to provide a liquid ejecting head which can suppress erosion of silicon substrates due to liquid and suppress leakage of liquid, discharging failure of liquid droplets, and peeling-off of laminated substrates, and a liquid ejecting apparatus.

An aspect of the invention is directed to a liquid ejecting head at least including a nozzle plate on which nozzle openings for discharging liquid are provided; and a flow path formation substrate on which a pressure generation chamber communicating with the nozzle openings is provided, wherein the nozzle plate is formed with a silicon substrate, and at least the flow path formation substrate and the nozzle plate are bonded to each other after providing a tantalum oxide film formed by atomic layer deposition on the entire surfaces including a bonded surface.

According to the aspect, by providing the tantalum oxide film on the flow path formation substrate and the nozzle plate, it is possible to suppress erosion of the flow path formation substrate and the nozzle plate by liquid. In addition, since the tantalum oxide film is provided on the bonded surface of the flow path formation substrate and the nozzle plate, it is possible to suppress erosion of the substrates by liquid which invades from an adhered boundary surface. Accordingly, it is possible to suppress a decrease of adhesion strength, and suppress leakage of liquid, discharging failure, and peeling-off of the laminated substrates.

It is preferable that the tantalum oxide film is formed with a thickness of equal to or greater than 0.3 Å and equal to or smaller than 50 nm. According to this configuration, resistance to liquid is sufficiently secured, and there are no effects of affecting opening states in the flow path of the flow path formation substrate and in the nozzle openings.

It is preferable that the liquid ejecting head further includes a communication plate on which a nozzle communication path for communication of the pressure generation chamber and the nozzle openings, be provided between the flow path formation substrate and the nozzle plate. According to this configuration, it is possible to suppress erosion of an adhered boundary surface between the flow path formation substrate and the communication plate, and an adhered boundary surface of the communication plate and the nozzle plate by the liquid.

It is preferable that the communication plate is formed with a silicon substrate, and the tantalum oxide film is provided on the entire surface including the bonded surface of the communication plate. According to this configuration, it is possible to suppress erosion of the communication plate by the tantalum oxide film, and it is possible to form the tantalum oxide film in the nozzle communication path having a narrow opening area, with an even and relatively small film thickness.

Another aspect of the invention is directed to a liquid ejecting apparatus including the liquid ejecting head according to the aspect described above.

According to the aspect, it is possible to realize a liquid ejecting apparatus which suppresses leakage of liquid, discharging failure, and breakdown such as peeling-off of substrates.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments of the invention will be described in detail.

Embodiment 1

Figure 1:
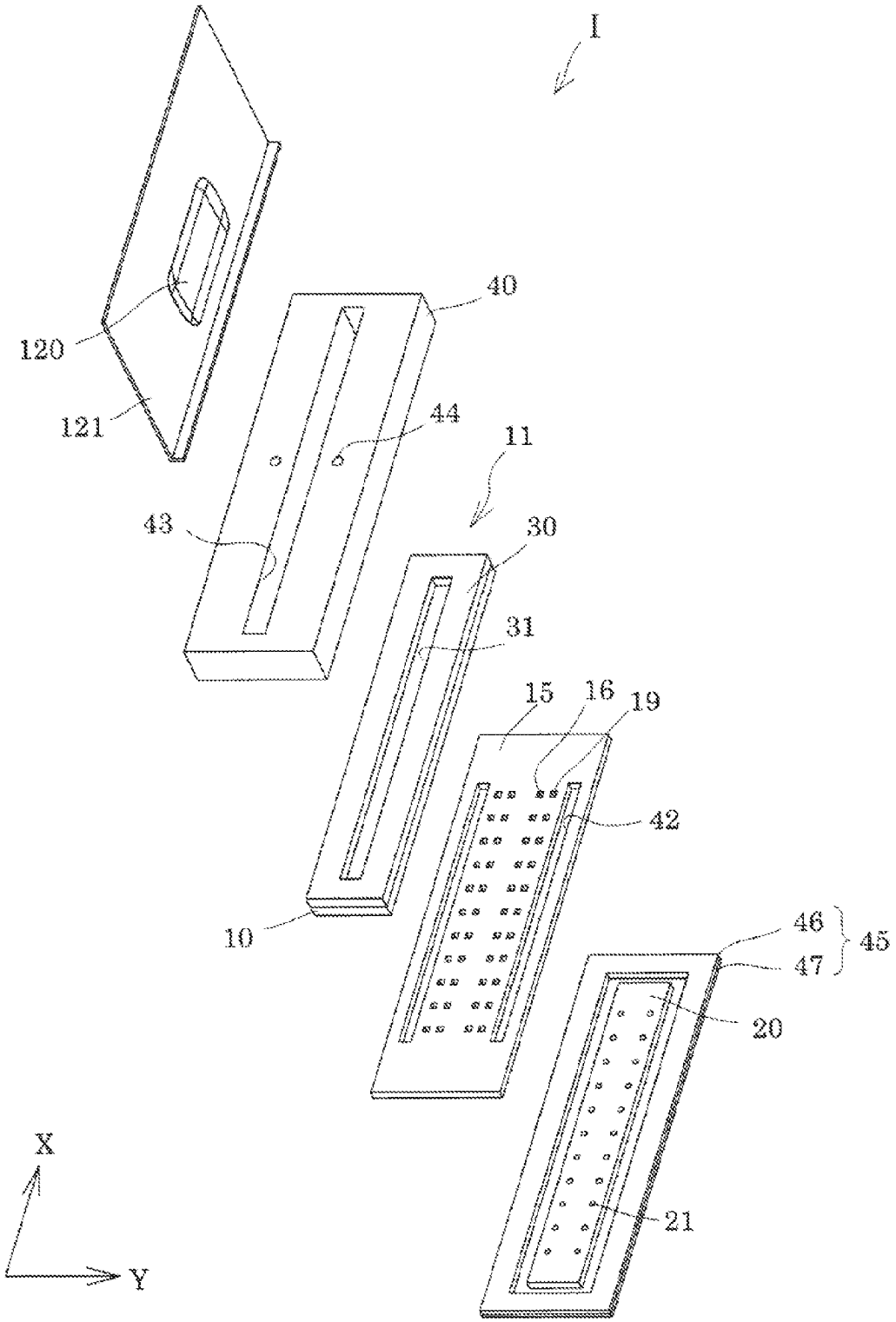
FIG. 1 is an exploded perspective view of a recording head according to Embodiment 1 of the invention.
Figure 2:
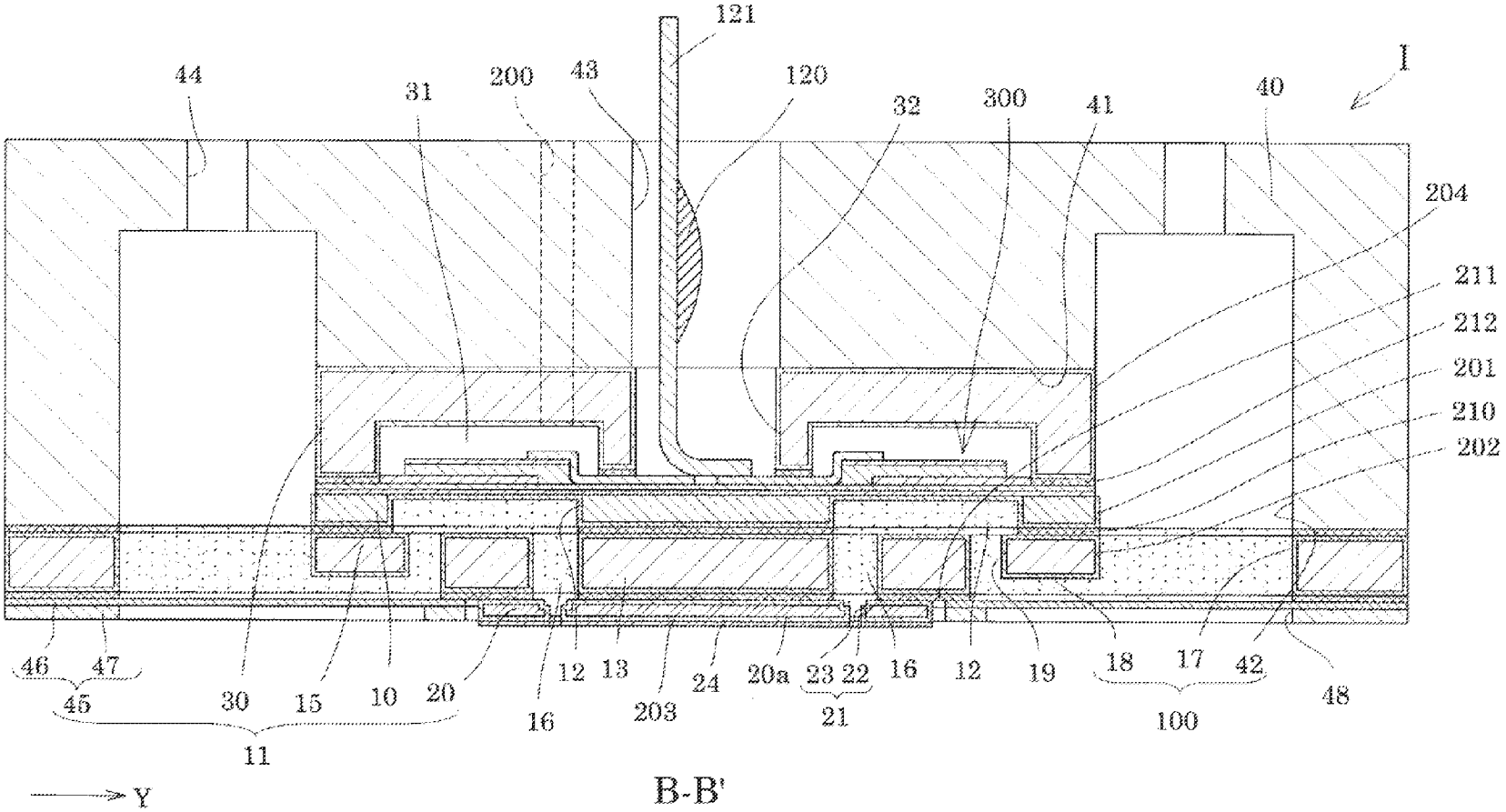
FIG. 2 is a cross-sectional view of a recording head according to Embodiment 1 of the invention.
Figure 3:
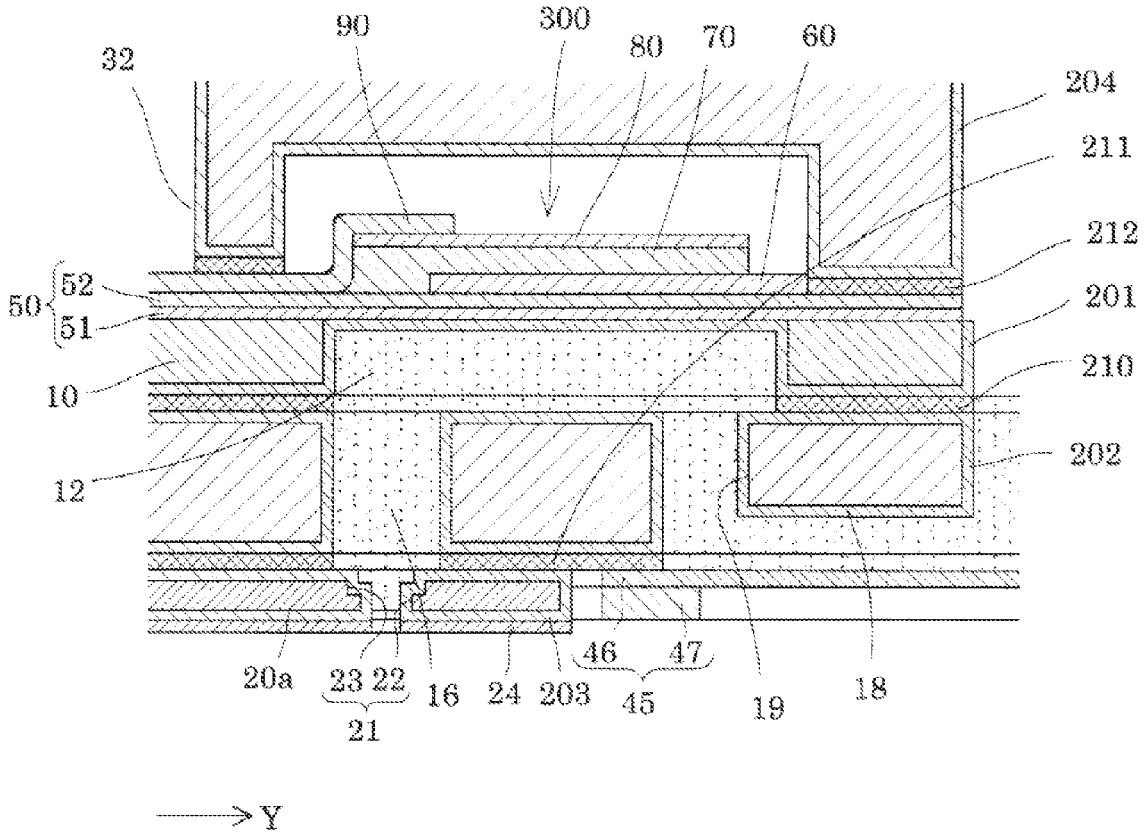
FIG. 3 is an enlarged cross-sectional view of a main part of a recording head according to Embodiment 1 of the invention.

FIG. 1 is an exploded perspective view of an inkjet type recording head which is an example of a liquid ejecting head according to Embodiment 1 of the invention, FIG. 2 is a cross-sectional view of an ink jet type recording head taken along a second direction, and FIG. 3 is an enlarged cross-sectional view of a main part of FIG. 2.

As shown in the drawings, an ink jet type recording head I which is an example of the liquid ejecting head of the embodiment includes a head main body 11 and a plurality of members such as a case member 40, and the plurality of members are bonded to each other with an adhesive or the like. In the embodiment, the head main body 11 includes a flow path formation substrate 10, a communication plate 15, a nozzle plate 20, a protection substrate 30, and a compliance substrate 45.

The flow path formation substrate 10 configuring the head main body 11 is formed of a silicon single-crystal substrate in the embodiment. In the flow path formation substrate 10, a plurality of pressure generation chambers 12 are provided in a line along a direction in which a plurality of nozzle openings 21 ejecting the same color of ink are provided in a line. Hereinafter, this direction is referred to as a direction in which the pressure generation chambers 12 are provided in a line or a first direction X. In the flow path formation substrate 10, a plurality of columns, two columns in the embodiment, are provided in which the pressure generation chambers 12 are provided in a line in the first direction X. Hereinafter, a direction in which the plurality of columns of the pressure generation chambers 12 in which the pressure generation chambers 12 are formed along the first direction X are provided is referred to as a second direction Y.

A first protection film 201 is formed on the flow path formation substrate 10 as a protection film which is a tantalum oxide film having tantalum oxide ($TaO_x$) as a main component which is formed by atomic layer deposition. The first protection film 201 is continuously provided over an inner wall surface (inner surface) of the pressure generation chamber 12 and a bonded surface of a surface which comes in contact with the ink such as end surfaces partitioning the inner surface of a manifold 100 and the communication plate 15 which will be specifically described later. In the embodiment, a tantalum oxide film formed of tantalum pentoxide ($Ta_2O_5$) is used as the first protection film 201. To be formed by atomic layer deposition is to be formed as a film by an atomic layer deposition method (ALD).

The communication plate 15 is bonded to one surface side (side opposite to a vibrating plate 50 which will be described later) of the flow path formation substrate 10. In addition, the nozzle plate 20 which the plurality of nozzle openings 21 communicating with each pressure generation chamber 12 penetrate is bonded to the communication plate 15. A nozzle communication path 16 which connects the pressure generation chamber 12 and the nozzle opening 21 to each other is provided on the communication plate 15. The communication plate 15 has an area larger than that of the flow path formation substrate 10, and the nozzle plate 20 has an area smaller than that of the flow path formation substrate 10. As described above, it is possible to save costs by relatively reducing the area of the nozzle plate 20. In the embodiment, a surface on which the nozzle opening 21 of the nozzle plate 20 is opened and through which ink droplets are ejected is referred to as a liquid ejection surface 20*a*.

A first manifold portion 17 and a second manifold portion 18 configuring a part of the manifold 100 are provided on the communication plate 15.

The first manifold portion 17 is provided to penetrate the communication plate 15 in a thickness direction (laminated direction of communication plate 15 and flow path formation substrate 10).

The second manifold portion 18 does not penetrate the communication plate 15 in the thickness direction, however is provided to open to the liquid ejection surface 20*a* side of the communication plate 15.

On the communication plate 15, an ink supply path 19 which communicates with one end portion of the pressure generation chamber 12 in the second direction Y is separately provided for each pressure generation chamber 12. The ink supply path 19 communicates the second manifold portion 18 and the pressure generation chamber 12 with each other.

A material having the same coefficient of linear expansion as that of the flow path formation substrate 10 is preferable for the communication plate 15. That is, in a case of using the material having a greatly different coefficient of linear expansion from that of the flow path formation substrate 10 for the communication plate 15, warping occurs due to the difference of coefficients of linear expansion between the flow path formation substrate 10 and the communication plate 15 when performing heating or cooling. In the embodiment, the warping due to heat can be suppressed by using the same material as the flow path formation substrate 10, that is, a silicon single-crystal substrate for the communication plate 15.

A second protection film 202 is formed on the communication plate 15 as a protection film which is a tantalum oxide film having tantalum oxide ($TaO_x$) as a main component which is formed by atomic layer deposition. The second protection film 202 is continuously provided over a bonded surface of a surface which comes in contact with the ink such as an inner wall surface (inner surface) of the nozzle communication path 16, the first manifold portion 17, the second manifold portion 18, and the ink supply path 19, and the flow path formation substrate 10, and a bonded surface thereof and the nozzle plate 20. In the embodiment, the same material as the first protection film 201, that is, tantalum pentoxide ($Ta_2O_5$) is used for the second protection film 202.

The nozzle plate 20 is formed with a silicon single-crystal substrate. Accordingly, the coefficients of linear expansion of the nozzle plate 20 and the communication plate 15 are set to be the same with each other to suppress occurrence of warping due to heating and cooling.

In the nozzle plate 20, a plurality of columns, two columns in the embodiment, in which the nozzle openings 21 are provided in a line in the first direction X, are provided in the second direction Y. Each nozzle opening 21 is formed by dry etching and is configured with two cylindrical empty portions which have different inner diameters from each other and communicate with each other. That is, the nozzle opening 21 is configured with a first cylindrical portion 22 having a smaller inner diameter which is formed on a side from which the ink of the nozzle plate 20 in a plate thickness direction is discharged, and a second cylindrical portion 23 having a larger inner diameter which is formed on a side (ink flow path side) opposite to the side from which the ink is discharged. The shape of the nozzle opening 21 is not limited to the nozzle opening described above as an example, and for example, the nozzle opening 21 may be configured from a cylindrical portion (straight portion) having a constant inner diameter and a tapered portion, an inner diameter of which gradually expands from an ejecting side to an ink flow path side. On both surfaces of the nozzle plate 20 and an inner periphery surface of the nozzle opening 21, a third protection film 203 is formed as a protection film which is a tantalum oxide film having tantalum oxide ($TaO_x$) as a main component which is formed by atomic layer deposition. In the embodiment, the same material as the first protection film 201 described above, that is, tantalum pentoxide ($Ta_2O_5$) is used as the third protection film 203.

In addition, a liquid repellent film 24 having a liquid repellent property is provided on the surface of the nozzle plate 20 (hereinafter, discharge side surface) from which the ink is discharged.

The liquid repellent film 24 is not particularly limited as long as it has a water repellent property with respect to the ink, and for example, a metal film containing a fluorine polymer or a molecular film of metal alkoxide having a liquid repellent property can be used.

A liquid repellent film formed of the metal film containing a fluorine polymer, for example, can be directly formed on the liquid ejection surface 20*a* of the nozzle plate 20 by performing eutectoid plating.

In addition, in a case of using the molecular film of metal alkoxide as the liquid repellent film, for example, by providing a base film formed of a plasma polymerization silicon (PPSi) film on the nozzle plate 20 side, it is possible to improve adhesiveness between the liquid repellent film formed of the molecular film and the nozzle plate 20. The base film formed of the plasma polymerization film, for example, can be formed by polymerizing silicone by argon plasma gas. The molecular film of metal alkoxide having a liquid repellent property is, for example, formed and then a drying process and an annealing process are performed, and thus the liquid repellent film formed of the molecular film can be set to a liquid repellent film (silane coupling agent (SCA) film). Further, in a case where the molecular film of metal alkoxide is used as the liquid repellent film, although the base film is provided, the film has advantages that the film can be formed thinner than the liquid repellent film formed of the metal film containing the fluorine polymer formed by eutectoid plating, and an "abrasion resistant property" in which the liquid repellent property is not degraded even when wiping the liquid ejection surface 20*a* when cleaning the liquid ejection surface 20*a*, and the liquid repellent property can be improved. Although the "abrasion resistant property" and the "liquid repellent property" are degraded, the liquid repellent film formed of the metal film containing the fluorine polymer can be used.

On the other hand, the vibrating plate 50 is formed on the other surface side (surface side opposite to the communication plate 15) of the flow path formation substrate 10. The vibrating plate 50 according to the embodiment is configured with an elastic film 51 which is formed on the flow path formation substrate 10 and an insulating film 52 which is formed on the elastic film 51. The pressure generation chamber 12 is formed by anisotropic etching of the flow path formation substrate 10 from one surface thereof, and the other surface of the pressure generation chamber 12 is configured with the vibrating plate (elastic film 51).

A piezoelectric actuator 300 formed of a first electrode 60, a piezoelectric layer 70, and a second electrode is provided on the vibrating plate 50 as a pressure generation unit of the embodiment. Herein, the piezoelectric actuator 300 is a portion including the first electrode 60, the piezoelectric layer 70, and the second electrode 80. In general, any one electrode of the piezoelectric actuator 300 is set to a common electrode, and the other electrode and the piezoelectric layer 70 are patterned for each pressure generation chamber 12. Herein, a portion which is configured from any one patterned electrode and the piezoelectric layer 70 and on which piezoelectric strain is generated by applying voltage to both electrodes is called a piezoelectric active portion. In the embodiment, the first electrode 60 is set to a common electrode of the piezoelectric actuator 300 and the second electrode 80 is set to an individual electrode of the piezoelectric actuator 300, however there is no problem in the reverse case according to circumstances of a driving circuit or wiring. In the example described above, the vibrating plate 50 is configured with the elastic film 51 and the insulating film 52, however this is not limited thereto, of course. For example, any one of the elastic film 51 and the insulating film 52 may be provided for the vibrating plate 50, and only the first electrode 60 may act as the vibrating plate without providing the elastic film 51 and the insulating film 52 as the vibrating plate 50. In addition, the piezoelectric actuator 300 itself may substantially function as the vibrating plate. However, in a case of providing the first electrode 60 directly on the flow path formation substrate 10, it is necessary to protect the first electrode 60 with an insulating protection film (first protection film 201) so that the first electrode 60 and the ink are not electrically connected to each other.

The piezoelectric layer 70 is formed of a piezoelectric material such as oxide having a polarized structure which is formed on the first electrode 60, and for example, can be formed of perovskite-type oxide shown as a general formula $ABO_3$. A can include lead, and B can include at least one of zirconium and titanium. B can further include niobium, for example. In detail, as the piezoelectric layer 70, for example, lead zirconate titanate ($Pb(Zr,Ti)O_3$: PZT), or lead zirconate titanate niobate ($Pb(Zr,Ti,Nb)O_3$: PZTNS) containing silicon can be used.

The piezoelectric layer 70 may be set to composite oxide having a perovskite structure containing a lead-free piezoelectric material which does not contain lead such as bismuth ferrate or bismuth manganate ferrate, and barium titanate or bismuth potassium titanate, for example.

One end of a lead electrode 90 is connected to the second electrode 80. A wiring substrate 121, for example, COF or the like on which a driving circuit 120 is provided is connected to the other end of the lead electrode 90.

The protection substrate 30 having substantially the same size as the flow path formation substrate 10 is bonded to the surface of the flow path formation substrate 10 on the piezoelectric actuator 300 side. The protection substrate 30 includes a holding portion 31 which is a space for protecting the piezoelectric actuator 300. In addition, a penetration hole 32 is provided on the protection substrate 30. The other end side of the lead electrode 90 is provided to extend so as to be exposed in the inside of the penetration hole 32, and the lead electrode 90 and the wiring substrate 121 are electrically connected to each other in the penetration hole 32.

The case member 40 partitioning the manifold 100 communicating with the plurality of pressure generation chambers 12 with the head main body 11 is fixed to the head main body 11 having the configuration described above. The case member 40 has substantially the same shape as the communication plate 15 described above in a plan view, and is fixed to the protection substrate 30 with an adhesive and is also fixed to the communication plate 15 described above with an adhesive. In detail, the case member 40 has a recess 41 having a depth to accommodate the flow path formation substrate 10 and the protection substrate 30 on the protection substrate 30 side. The recess 41 has an opening area wider than the surface of the protection substrate 30 which is bonded to the flow path formation substrate 10. The opening surface of the recess 41 on the nozzle plate 20 side is sealed by the communication plate 15 in a state where the flow path formation substrate 10 or the like is accommodated in the recess 41. Accordingly, a third manifold portion 42 is provided to be partitioned by the case member 40 and the head main body 11 on the outer periphery portion of the flow path formation substrate 10. The manifold 100 of the embodiment is configured with the first manifold portion 17 and the second manifold portion 18 provided on the communication plate 15, and the third manifold portion 42 partitioned by the case member 40 and the flow path formation substrate 10.

A resin or metal can be used, for example, as the material of the case member 40. In addition, the material of the protection substrate 30 is preferably a material having the same coefficient of linear expansion as that of the flow path formation substrate 10 adhered to the protection substrate 30, and in the embodiment, the silicon single-crystal substrate is used.

A fourth protection film 204 is formed on the surface of the protection substrate 30 as a protection film which is a tantalum oxide film having tantalum oxide ($TaO_x$) as a main component which is formed by atomic layer deposition. In detail, the fourth protection film 204 is continuously provided over the surface which comes in contact with the ink such as end surfaces partitioning the manifold 100, the surface bonded to the flow path formation substrate 10, and the inner surface of the holding portion 31. In the embodiment, the same material as the first protection film 201 described above, that is, tantalum pentoxide ($Ta_2O_5$) is used for the fourth protection film 204.

The compliance substrate 45 is provided on the surface of the communication plate 15 on the liquid ejection surface 20*a* side on which the first manifold portion 17 and the second manifold portion 18 are opened. The compliance substrate 45 seals the opening of the first manifold portion 17 and the second manifold portion 18 on the liquid ejection surface 20*a* side.

The compliance substrate 45 includes a sealing film 46 and a fixed substrate 47, in the embodiment. The sealing film 46 is formed of a thin film (for example, thin film having a thickness of 20 μm or less which is formed with polyphenylene sulfide (PPS) or stainless steel (SUS)) having flexibility, and the fixed substrate 47 is formed with a hard material, for example, metal such as stainless steel (SUS). Since the region of the fixed substrate 47 facing the manifold 100 is set to an opening portion 48 which is completely removed in the thickness direction, one surface of the manifold 100 is a compliance portion which is a flexible portion which is sealed only with the sealing film 46 having flexibility.

An introduction path 44 which communicates with the manifold 100 to supply the ink to each manifold 100 is provided on the case member 40. In addition, a connection port 43 which communicates with the penetration hole 32 of the protection substrate 30 and through which the wiring substrate 121 penetrates is provided on the case member 40.

In the ink jet type recording head I having the configuration described above, when ejecting the ink, the ink is introduced from an ink storage unit such as a cartridge through the introduction path 44, and the inside of the flow path from the manifold 100 to the nozzle opening 21 is filled with the ink. After that, the voltage is applied to each piezoelectric actuator 300 corresponding to the pressure generation chamber 12 according to the signal from the driving circuit 120, and accordingly the piezoelectric actuator 300, the elastic film 51, and the insulating film 52 are deformed. Therefore, the pressure in the pressure generation chamber 12 is increased, and ink droplets are ejected from the predetermined nozzle openings 21.

Herein, on the substrates formed with silicon substrates (silicon single-crystal substrates) configuring the ink jet type recording head I of the embodiment, that is, the flow path formation substrate 10, the communication plate 15, the nozzle plate 20, and the protection substrate 30, a protection film which is a tantalum oxide film having tantalum oxide ($TaO_x$) as a main component which is formed by atomic layer deposition is provided.

In detail, the first protection film 201 which is a tantalum oxide film having tantalum oxide ($TaO_x$), tantalum pentoxide ($Ta_2O_5$) in the embodiment, as a main component which is formed by atomic layer deposition is provided on the surface of the flow path formation substrate 10.

The first protection film 201 is continuously provided over the inner wall surface (inner surface) of the pressure generation chamber 12, that is, an upper portion of a partition wall partitioning the pressure generation chamber 12 and the upper portion of the vibrating plate 50, and the bonded surface of the end surface partitioning the inner surface of the manifold 100 and the communication plate 15.

As described above, the first protection film 201 is formed with a tantalum oxide film, and accordingly can suppress erosion of the flow path formation substrate 10 and the vibrating plate 50 by the ink, as the first protection film 201 having an ink resistant property. The ink resistant property (resistance to liquid) herein is an etching resistant property with respect to alkaline or acidic ink (liquid).

In addition, by forming the first protection film 201 by the atomic layer deposition method, the first protection film 201 can be formed in a compact state with high film density. As described above, by forming the first protection film 201 with high film density, the ink resistant property (resistance to liquid) of the first protection film 201 can be improved. That is, the first protection film 201 is formed with tantalum oxide to have the ink resistant property, and by forming the first protection film with the atomic layer deposition method (ALD), the ink resistant property of the first protection film 201 can be further improved. Accordingly, the ink resistant property of the first protection film 201 is improved, and the erosion (etching) of the vibrating plate 50 (elastic film 51) or the flow path formation substrate 10 by the ink (liquid) can be suppressed. Since it is possible to form the highly-compact first protection film 201 with the high ink resistant property and the high film density by the atomic layer deposition method, although the first protection film 201 is formed with a thinner film thickness compared to the case of forming thereof by a CVD method, a sufficient ink resistant property can be secured. Accordingly, the first protection film 201 is formed with a relatively thin film thickness, and it is possible to suppress inhibition of displacement of the vibrating plate 50 by the first protection film 201, and accordingly it is possible to suppress a decrease in a displacement amount of the vibrating plate 50. In addition, since it is possible to suppress erosion of the vibrating plate 50 by the ink, it is possible to suppress the generation of variation in the displacement property of the vibrating plate 50, and accordingly it is possible to deform the vibrating plate 50 with a stable displacement property.

By forming the first protection film 201 by the atomic layer deposition method, the first protection film 201 can be formed on the inner surface of the flow path of the flow path formation substrate 10 having concavities and convexities of the pressure generation chamber 12 or the like, that is, on the vibrating plate 50 (elastic film 51) or on the partition wall, with a substantially even film thickness. That is, after forming the elastic film 51 which is the vibrating plate 50 or the piezoelectric actuator 300 on one surface of the flow path formation substrate 10, the flow path of the pressure generation chamber 12 or the like is formed on the flow path formation substrate 10, and then the first protection film 201 is formed in the flow path of the pressure generation chamber or the like by the atomic layer deposition method. Accordingly, in a case where the protection film is formed by a method other than the atomic layer deposition method, for example, a sputtering method or the CVD method, it is difficult to form the first protection film 201 to have an even thickness on the surface in different directions. In the embodiment, by forming the first protection film 201 by the atomic layer deposition method, it is possible to form the film on the surface in different directions with an even film thickness, suppress generation of variation in a displacement property of the vibrating plate, and suppress erosion of the vibrating plate 50 or the flow path formation substrate 10 by the ink due to a coverage problem of the first protection film 201.

The thickness of the first protection film 201 which is the tantalum oxide film having tantalum oxide as a main component which is formed by atomic layer deposition is preferably in a range of 0.3 Å to 50 nm, and is more preferably in a range of 10 nm to 30 nm. In addition, $Ta_2O_5$ ($TaO_x$) is soluble in an alkali, but if the film density is high (approximately 7 g/cm$^2$), it is hardly soluble in an alkali, and since acid resistivity thereof has a property of not dissolving in a solution other than hydrogen fluoride, $Ta_2O_5$ is efficient for the protection film with respect to a strongly alkaline solution or a strongly acidic solution. That is, it is possible to easily form the first protection film 201 with a relatively thin thickness which is equal to or smaller than 50 nm with high precision, by the atomic layer deposition method. Since a protection film 200 which is formed by the atomic layer deposition method is formed with the high film density, a sufficient ink resistant property can be secured with a thickness of equal to or greater than 0.3 Å. In addition, if the first protection film 201 is formed to be thicker than that, it is not preferable since a longer time is taken and cost increases for forming the film. If the first protection film 201 is formed to be thinner than that, it is not preferable since there is a concern that an even film is not formed over the entirety.

As described above, by setting the thickness of the first protection film 201 smaller, it is possible to suppress inhibition of displacement of the vibrating plate 50 by the first protection film 201 and to improve the displacement of the piezoelectric actuator 300. In addition, since the thickness of the first protection film 201 can be set smaller, even if the thickness of the flow path formation substrate 10 is made smaller, it is possible to secure capacity of the pressure generation chamber 12. Further, since it is possible to improve the displacement of the piezoelectric actuator 300, it is possible to set the thickness of the piezoelectric actuator 300 smaller. Accordingly, it is possible to realize the thin ink jet type recording head I and high density of the nozzle openings 21.

The second protection film 202 which is a tantalum oxide film having tantalum oxide ($TaO_x$), tantalum pentoxide ($Ta_2O_5$) in the embodiment, as a main component which is formed by atomic layer deposition (atomic layer deposition method) is provided on the surface of the communication plate 15. The second protection film 202 is continuously provided over the inner surface of the nozzle communication path 16 of the communication plate 15, the bonded surface of the surface of the first manifold portion 17, the second manifold portion 18, and the ink supply path 19 with which the ink comes in contact, and the flow path formation substrate 10, and the bonded surface thereof and the nozzle plate 20.

As described above, in the same manner as the first protection film 201, the second protection film 202 is formed with a tantalum oxide film to have the ink resistant property, and is formed by the atomic layer deposition method, and accordingly, it is possible to further improve the ink resistant property of the second protection film 202. Accordingly, it is possible to improve the ink resistant property of the second protection film 202 to suppress the erosion (etching) of the communication plate 15 by the ink (liquid). In addition, since it is possible to form the compact second protection film 202 having a high ink resistant property and high film density by the atomic layer deposition method, although it is formed with a smaller film thickness compared to the case of forming the second protection film 202 by the CVD method or the like, it is possible to secure a sufficient ink resistant property.

By forming the second protection film 202 by the atomic layer deposition method, the second protection film 202 can be formed on the inner surface of the flow path of the nozzle communication path 16 or the communication plate 15 having concavities and convexities of the first manifold portion 17, with a substantially even film thickness. Particularly, the opening area of the nozzle communication path 16 or the ink supply path 19 is small and it is difficult to form the second protection film 202 on the inner periphery surface thereof, however, by forming the second protection film 202 by the atomic layer deposition method, the second protection film 202 can be formed on the inner surface of the nozzle communication path 16 or the ink supply path 19 having a small opening area, with a substantially even film thickness. The second protection film 202 having high film density can be also reliably formed on corner portions of the nozzle communication path 16 or the inks supply path 19, and the ink resistance of the communication plate 15 is significantly improved.

In the same manner as the first protection film 201, the thickness of the second protection film 202 is preferably in a range of 0.3 Å to 50 nm, and is more preferably in a range of 10 nm to 30 nm.

The flow path formation substrate 10 and the communication plate 15 are adhered to each other through an adhesive 210. An epoxy adhesive, for example, can be used as the adhesive 210 for adhering the flow path formation substrate 10 and the communication plate 15 to each other. Herein, in the embodiment, the first protection film 201 and the second protection film 202 are formed on the adhered surface of the flow path formation substrate 10 and the communication plate 15, respectively. Accordingly, when the ink invades the boundary surface of the adhesive 210 for adhering the flow path formation substrate 10 and the communication plate 15 to each other, it is possible to suppress erosion (etching) of the flow path formation substrate 10 and the communication plate 15 by the ink, reduction of the adhered area, the leakage or discharging failure of the ink due to the decrease of the adhesion strength, and peeling-off thereof due to the decrease of the adhesion strength. That is, even if the protection films (first protection film 201 and second protection film 202) are formed on only the inner portion of the flow path of the flow path formation substrate 10 and the communication plate 15, if the boundary surface of the adhesive 210 is not protected by the protection films, the adhered boundary surface is eroded by the ink and the adhesion strength is decreased. In the embodiment, not only the inner surface of the flow path of the flow path formation substrate 10 and the communication plate 15, but also the adhered boundary surface thereof is covered by the protection films (first protection film 201 and second protection film 202), and accordingly it is possible to suppress erosion (etching) of the flow path formation substrate 10 and the communication plate 15 by the ink and the decrease of the adhesion strength. Particularly, in the embodiment, since the protection films (first protection film 201 and second protection film 202) are continuously provided over the inner surface of the flow path and the boundary surface which comes in contact with the adhesive 210, the protection films are seamless, and accordingly, it is possible to suppress erosion thereof by the invasion of the ink from the seam, and to reliably protect the flow path formation substrate 10 and the communication plate 15.

The third protection film 203 which is a tantalum oxide film having tantalum oxide ($TaO_x$), tantalum pentoxide ($Ta_2O_5$) in the embodiment, as a main component which is formed by atomic layer deposition is provided on the surface of the nozzle plate 20. The third protection film 203 is formed by atomic layer deposition (atomic layer deposition method), can be formed with a smaller film thickness compared to the film formed by another gas phase method such as the CVD method, and can be reliably formed on the inner periphery surface of the small nozzle openings 21 with an even film thickness. In addition, it is advantageous that the third protection film can be formed with high film density, when using the atomic layer deposition method. That is, by forming the third protection film 203 with the high film density, it is possible to improve the ink resistant property (resistance to liquid) of the third protection film 203 and suppress erosion of the silicon substrates by the ink (liquid). In particular, since the third protection film 203 is reliably formed even on the inner periphery surface of the nozzle openings 21 or the corner portions of the boundary surfaces of the surface on the liquid ejection surface 20*a* side and the nozzle openings 21 in which a problem easily occurs in the ink resistant property, with high film density, the ink resistant property of the nozzle plate 20 is significantly improved.

In the same manner as the first protection film 201, the thickness of the third protection film 203 is preferably in a range of 0.3 Å to 50 nm, and is more preferably in a range of 10 nm to 30 nm.

The communication plate 15 and the nozzle plate 20 are adhered to each other through an adhesive 211. An epoxy adhesive, for example, can be used as the adhesive 211 for adhering the communication plate 15 and the nozzle plate 20 to each other. Herein, in the embodiment, the second protection film 202 and the third protection film 203 are formed on the adhered surface of the communication plate 15 and the nozzle plate 20, respectively. Accordingly, even if the ink invades the boundary surface of the adhesive 211 for adhering the communication plate 15 and the nozzle plate 20 to each other, it is possible to suppress erosion (etching) of the communication plate 15 and the nozzle plate 20 by the ink. Accordingly, it is possible to suppress reduction of the adhered area due to the erosion of the ink, the leakage or discharging failure of the ink due to the decrease of the adhesion strength, and peeling-off thereof due to the decrease of the adhesion strength. That is, when the protection films (second protection film 202 and third protection film 203) are formed on only the inner portion of the flow path of the communication plate 15 and the nozzle plate 20 (including nozzle openings 21), if the boundary surface of the adhesive 211 is not protected by the protection films, the adhered boundary surface is eroded by the ink and the adhesion strength is decreased. In the embodiment, not only the inner surface of the flow path of the communication plate 15 and the nozzle plate 20, but also the adhered boundary surface thereof is covered by the protection films (second protection film 202 and third protection film 203), and accordingly it is possible to suppress erosion (etching) of the communication plate 15 and the nozzle plate 20 by the ink and the decrease of the adhesion strength. Particularly, in the embodiment, since the protection films (second protection film 202 and third protection film 203) are continuously provided over the inner surface of the flow path and the boundary surface which comes in contact with the adhesive 211, the protection films are seamless, and accordingly, it is possible to suppress erosion thereof by the invasion of the ink from the seam, and to reliably protect the communication plate 15 and the nozzle plate 20.

The fourth protection film 204 which is a tantalum oxide film having tantalum oxide ($TaO_x$), tantalum pentoxide ($Ta_2O_5$) in the embodiment, as a main component which is formed by atomic layer deposition (atomic layer deposition method) is provided on the surface of the protection substrate 30.

In the embodiment, the fourth protection film 204 is continuously provided over the inner surface of the holding portion 31 of the protection substrate 30, the outer periphery surface of the protection substrate 30, and a bonded surface with the flow path formation substrate 10.

In the same manner as the first protection film 201, the fourth protection film 204 is formed with a tantalum oxide film to have the ink resistant property, and is formed by the atomic layer deposition method (ALD), and accordingly, it is possible to further improve the ink resistant property of the fourth protection film 204. Accordingly, it is possible to improve the ink resistant property of the fourth protection film 204 to suppress the erosion (etching) of the protection substrate 30 by the ink (liquid). In addition, since it is possible to form the compact fourth protection film 204 having a high ink resistant property and high film density by the atomic layer deposition method, although it is formed with a smaller film thickness compared to the case of forming the fourth protection film 204 by the CVD method or the like, it is possible to secure a sufficient ink resistant property.

The flow path formation substrate 10 and the protection substrate 30 are adhered to each other through an adhesive 212. An epoxy adhesive, for example, can be used as the adhesive 212 for adhering the flow path formation substrate 10 and the protection substrate 30 to each other. Herein, in the embodiment, since the fourth protection film 204 is formed on the adhered surface of the protection substrate 30 with the flow path formation substrate 10, although the ink invades the boundary surface of the adhesive 212 for adhering the protection substrate 30 to the flow path formation substrate 10, it is possible to suppress erosion (etching) of the protection substrate 30 by the ink. Therefore, it is possible to suppress reduction of the adhered area due to the erosion of the ink, the leakage or discharging failure of the ink due to the decrease of the adhesion strength, and peeling-off thereof due to the decrease of the adhesion strength. That is, when the protection film (fourth protection film 204) is formed on only the inner portion of the holding portion 31 of the protection substrate 30, if the boundary surface of the adhesive 212 is not protected by the protection film, the adhered boundary surface is eroded by the ink and the adhesion strength is decreased. In the embodiment, not only the end surface partitioning the manifold 100 of the protection substrate 30, but also the adhered boundary surface thereof is covered by the protection film (fourth protection film 204), and accordingly it is possible to suppress erosion (etching) of the protection substrate 30 by the ink and the decrease of the adhesion strength. Particularly, in the embodiment, since the protection film (fourth protection film 204) is continuously provided over the inner surface of the flow path and the boundary surface which comes in contact with the adhesive 212, the protection film is seamless, and accordingly, it is possible to suppress erosion thereof by the invasion of the ink from the seam, and to reliably protect the protection substrate 30. In addition, in the embodiment, a protection film is not formed on the adhered surface of the flow path formation substrate 10 adhered to the protection substrate 30. However, the vibrating plate 50 or the like is formed on the adhered surface of the flow path formation substrate 10 adhered to the protection substrate 30, and the boundary surface of the flow path formation substrate 10 and the adhesive 212 is not invaded by the ink.

As described above, on the entire surfaces including the bonded surfaces of the silicon substrates (silicon single-crystal substrates) configuring the ink jet type recording head I of the embodiment, the flow path formation substrate 10, the communication plate 15, the nozzle plate 20, and the protection substrate 30 in the embodiment, the protection films (first protection film 201 to fourth protection film 204) which are tantalum oxide films having tantalum oxide ($TaO_x$) as a main component which are formed by atomic layer deposition method (ALD) are formed, and each of substrates (10, 15, 20, and 30) is adhered with the bonded surface on which the protection films (201 to 204) are provided, through the adhesives 210 to 212. Accordingly, it is possible to reliably protect each substrate by the protection film from the ink (liquid), and by providing the protection films on the adhered boundary surfaces, it is possible to suppress erosion of each substrate by the ink which invades between the adhesives 210 to 212 and the substrate, and suppress malfunctions such as leakage of ink due to decrease of adhesiveness, the ink discharging failure, and the peeling-off of the laminated substrates.

Herein, a manufacturing method of the ink jet type recording head I of the embodiment will be described with reference to FIGS. 4A to 6. FIGS. 4A to 6 are enlarged cross-sectional views of a main part showing the manufacturing method of the ink jet type recording head I according to Embodiment 1 of the invention.

Figure 4A:
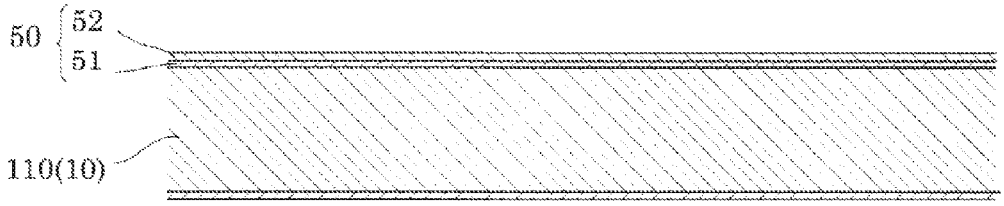
FIGS. 4A to 4C are cross-sectional views showing a manufacturing method of a recording head according to Embodiment 1 of the invention.

As shown in FIG. 4A, the vibrating plate 50 is formed on one surface of a flow path formation substrate wafer 110 which is a silicon wafer and is the plurality of flow path formation substrates 10. In the embodiment, the vibrating plate 50 which is formed of laminated layers of silicon dioxide (elastic film 51) formed by thermal oxidation of the flow path formation substrate wafer 110 and zirconium oxide (insulating film 52) formed by thermal oxidation after forming a film by a sputtering method, is formed.

Of course, the materials of the vibrating plate 50 are not limited to silicon dioxide and zirconium oxide, and silicon nitride ($Si_3N_4$), titanium oxide ($TiO_2$), aluminum oxide ($Al_2O_3$), hafnium oxide ($HfO_2$), magnesium oxide (MgO), lanthanum aluminate ($LaAlO_3$), and the like may be used. A forming method of the elastic film 51 is not limited to thermal oxidation, and the elastic film may be formed by a sputtering method, a CVD method, a vapor-deposition method, a spin-coating method, or a combination thereof.

Figure 4B:
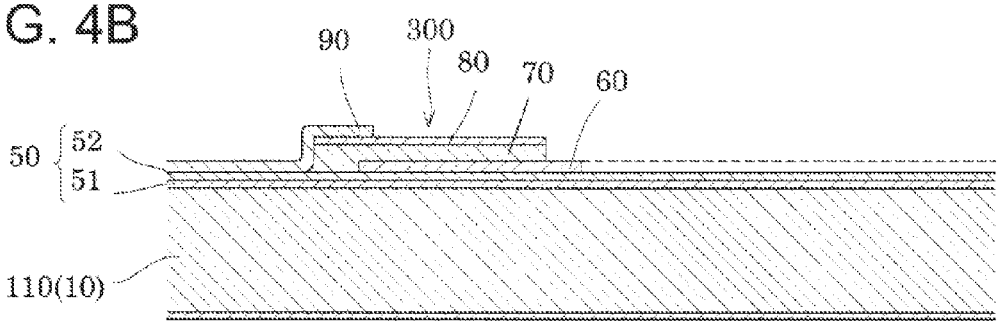

Next, as shown in FIG. 4B, the piezoelectric actuator 300 and the lead electrode 90 are formed on the vibrating plate 50. Each layer of the piezoelectric actuator 300 and the lead electrode 90 can be formed for each pressure generation chamber 12 by forming films and a lithography method. In addition, the piezoelectric layer 70 can be formed using a PVD method such as a sol-gel method, an MOD method, a sputtering method or laser ablation.

Figure 4C:
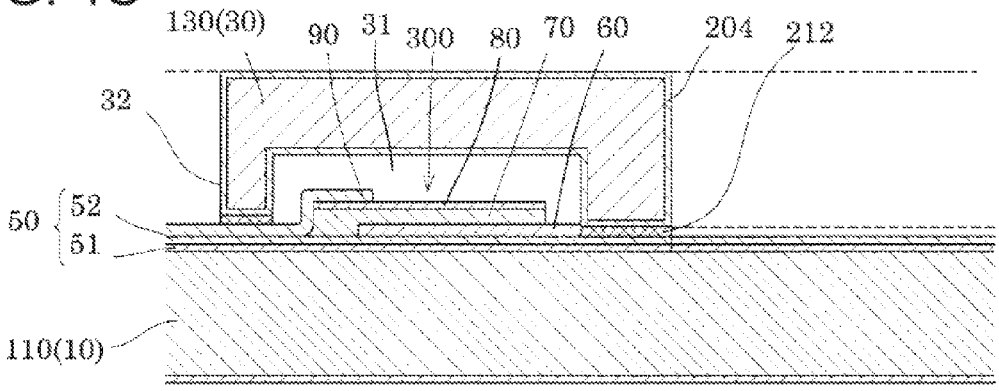

Next, as shown in FIG. 4C, a protection substrate wafer 130 which is a silicon wafer and is the plurality of protection substrates 30 is bonded to the piezoelectric actuator 300 side of the flow path formation substrate wafer 110 through the adhesive 212. On the protection substrate wafer 130 to be bonded to the flow path formation substrate wafer 110, after previously forming the holding portion 31 or the penetration hole 32, the fourth protection film 204 which is formed of tantalum oxide by the atomic layer deposition method is formed over the entire surfaces of the surface of the protection substrate wafer 130, in advance. The protection substrate wafer 130 on which the fourth protection film 204 is formed and the flow path formation substrate wafer 110 are adhered to each other through the adhesive 212.

At that time, since the fourth protection film 204 is formed on the adhered boundary surface of the protection substrate wafer 130 which comes in contact with the adhesive 212, even if the ink invades the adhered boundary surface when the ink jet type recording head I is filled with the ink, it is possible to suppress erosion of the adhered boundary surface of the protection substrate 30 (cut from the protection substrate wafer 130) by the ink, improve the adhesion strength, and suppress the leakage of ink, the discharging failure, and the peeling-off.

The method of forming the holding portion 31 and the penetration hole 32 on the protection substrate wafer 130 is not particularly limited, and the holding portion 31 and the penetration hole 32 can be formed by anisotropic etching using an alkaline solution such as KOH, for example, with high precision.

Figure 5A:
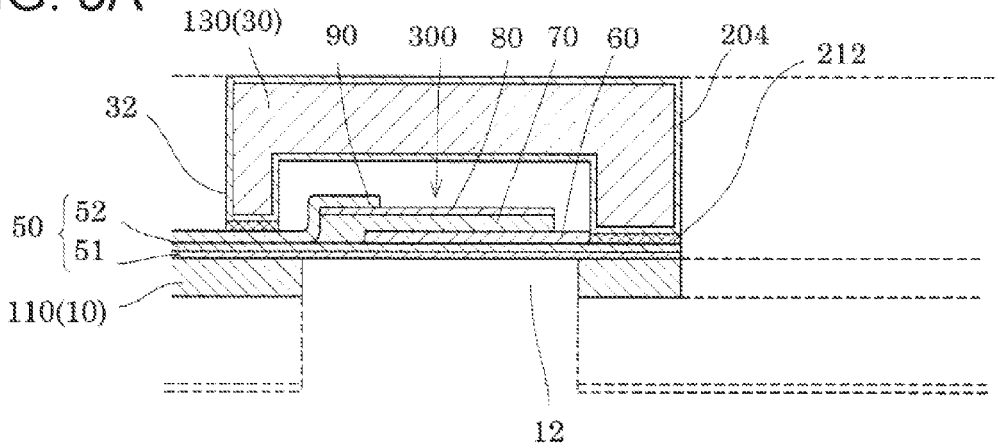
FIGS. 5A to 5C are cross-sectional views showing a manufacturing method of a recording head according to Embodiment 1 of the invention.

Next, as shown in FIG. 5A, after setting the thickness of the flow path formation substrate wafer 110 to a predetermined thickness, by performing anisotropic etching of the flow path formation substrate wafer 110 from a surface side opposite to the protection substrate wafer 130 through a mask (not shown), the pressure generation chamber 12 corresponding to the piezoelectric actuator 300 is formed.

Figure 5B:
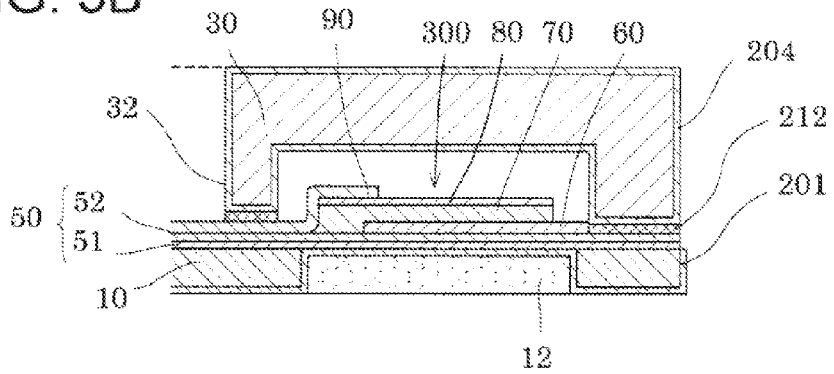

Next, as shown in FIG. 5B, the first protection film 201 which is formed of tantalum oxide is formed over the surface of the flow path formation substrate wafer 110 by the atomic layer deposition method. In the embodiment, the first protection film is continuously formed over a region of the flow path formation substrate wafer 110 which is not covered by the protection substrate wafer 130, that is, the inner surface of the pressure generation chamber 12, the end surface partitioning the inner surface of the manifold 100, and the bonded surface of the flow path formation substrate 10 with the communication plate 15. Unnecessary portions of the flow path formation substrate wafer 110 and the protection substrate wafer 130 are removed, and the flow path formation substrate wafer 110 and the protection substrate wafer 130 are divided into flow path formation substrates 10 and protection substrates 30 each of which have one chip size as shown in FIG. 1.

Figure 5C:
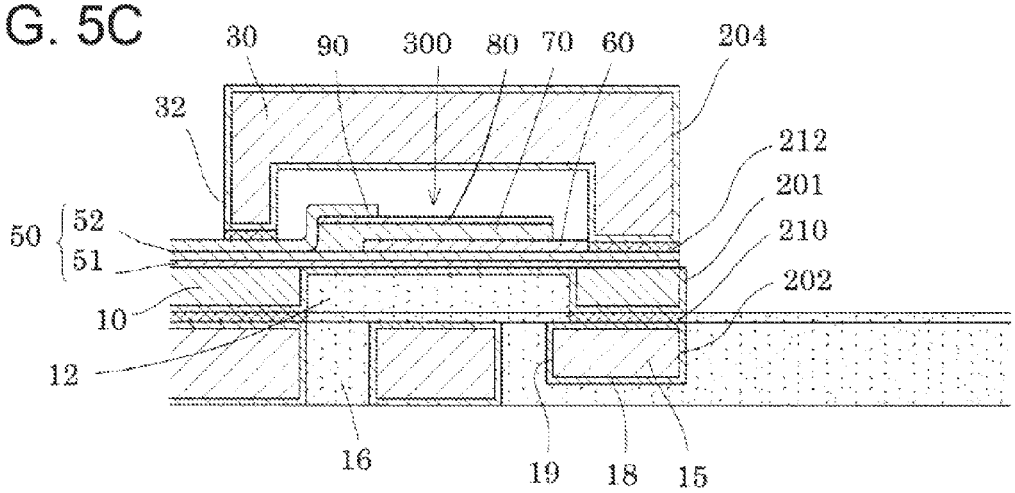

Next, as shown in FIG. 5C, the communication plate 15 is bonded to the divided flow path formation substrate 10. On the communication plate 15, after previously forming the nozzle communication path 16, the first manifold portion 17, the second manifold portion 18, and the ink supply path 19, the second protection film 202 formed of tantalum oxide is formed over the entire surface of the surface of the communication plate 15 by the atomic layer deposition method, in advance. At that time, since the second protection film 202 is formed by the atomic layer deposition method, the second protection film 202 can be formed with an even film thickness even on the inner surface of the nozzle communication path 16 or the ink supply path 19 having a complicated shape and narrow opening.

The flow path formation substrate 10 on which the first protection film 201 is formed and the communication plate 15 on which the second protection film 202 is formed are adhered to each other through the adhesive 210. At that time, since the first protection film 201 and the second protection film 202 are formed on each adhered boundary surface of the flow path formation substrate 10 and the communication plate 15 which comes in contact with the adhesive 210, even if the ink invades the adhered boundary surface when the ink jet type recording head I is filled with the ink, it is possible to suppress erosion of the adhered boundary surface of the flow path formation substrate 10 and the communication plate 15 by the ink, improve the adhesion strength, and suppress the leakage of ink, the discharging failure, and the peeling-off.

Figure 6:
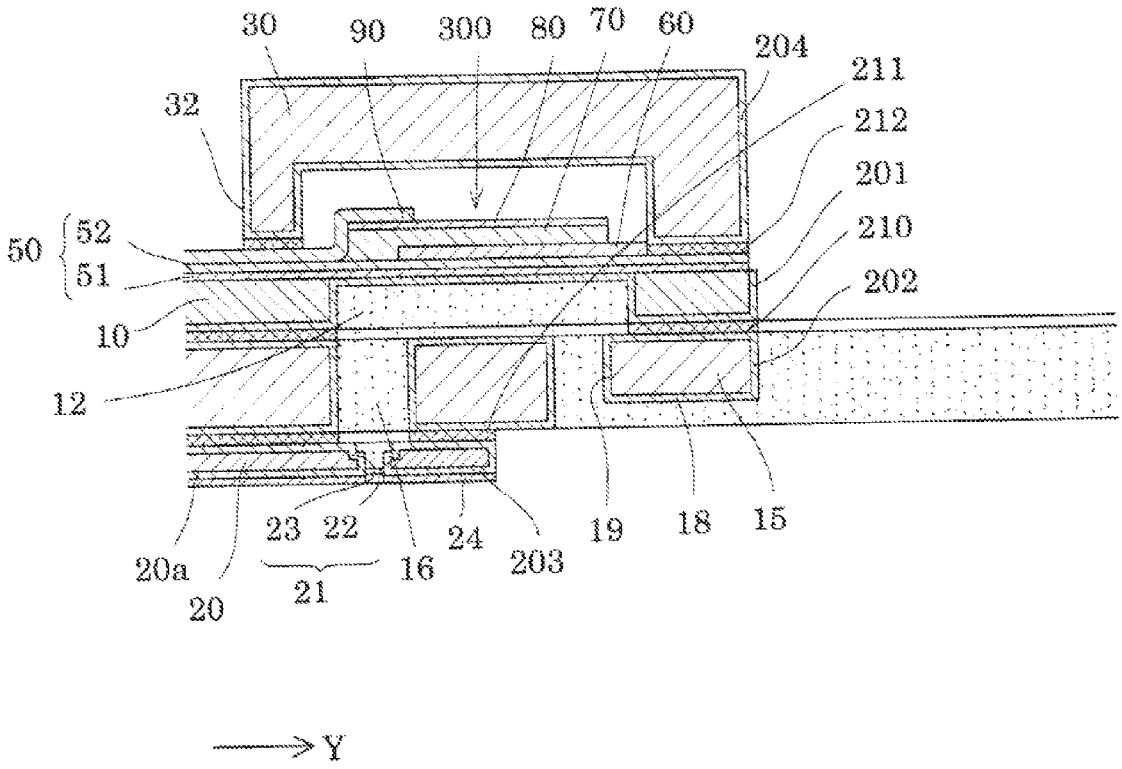
FIG. 6 is a cross-sectional view showing a manufacturing method of a recording head according to Embodiment 1 of the invention.

Next, as shown in FIG. 6, the nozzle plate 20 is adhered to the communication plate 15 through the adhesive 211. On the nozzle plate 20, after previously forming the nozzle opening 21, the third protection film 203 which is formed of tantalum oxide by the atomic layer deposition method is formed over the entire surfaces of the surface of the nozzle plate 20, in advance. In addition, the liquid repellent film 24 is previously formed on the liquid ejection surface 20*a* of the nozzle plate 20.

The communication plate 15 on which the second protection film 202 is formed and the nozzle plate 20 on which the third protection film 203 is formed are adhered to each other through the adhesive 211. At that time, since the second protection film 202 and the third protection film 203 are formed on each adhered boundary surface of the communication plate 15 and the nozzle plate 20 which comes in contact with the adhesive 211, even if the ink invades the adhered boundary surface when the ink jet type recording head I is filled with the ink, it is possible to suppress erosion of the adhered boundary surface of the communication plate 15 and the nozzle plate 20 by the ink, improve the adhesion strength, and suppress the leakage of ink, the discharging failure, and the peeling-off.

After that, the compliance substrate 45 is bonded to the communication plate 15 and the case member 40 is bonded thereto, and accordingly the ink jet type recording head I of the embodiment can be manufactured. Of course, since the second protection film 202 is also formed on the adhered boundary surface of the communication plate 15 with the compliance substrate 45, it is possible to suppress erosion of the adhered boundary surface of the communication plate 15 by the ink.

Other Embodiment

Hereinabove, the basic configuration of the invention has been described, however the basic configuration of the invention is not limited thereto.

For example, in Embodiment 1 described above, the flow path formation substrate 10 and the nozzle plate 20 are bonded to each other through the communication plate 15, however it is not particularly limited thereto, and for example, the flow path formation substrate 10 and the nozzle plate 20 may be directly bonded to each other. That is, as in Embodiment 1 described above, the bonding of the nozzle plate 20 and the flow path formation substrate 10 to each other includes the bonding thereof with the communication plate 15 interposed therebetween, or the direct bonding of the nozzle plate 20 and the flow path formation substrate 10 to each other. In addition, another substrate other than the communication plate 15 may be interposed between the nozzle plate 20 and the flow path formation substrate 10.

In addition, in Embodiment 1 described above, the case member 40 is formed with the resin or the metal, however, in a case where the case member 40 is formed with a material which is eroded by the ink, the protection film having tantalum oxide as a main component which is formed by atomic layer deposition method may be formed on the inner surface of the flow path of the case member 40 and the bonded surface thereof.

In Embodiment 1 described above, the pressure generation unit which discharges ink droplets from the nozzle opening 21 has been described using the thin film type piezoelectric actuator 300, however, it is not particularly limited thereto, and a thick film type piezoelectric actuator which is formed by a method of attaching a green sheet or a longitudinal vibration type piezoelectric actuator in which a piezoelectric material and an electrode forming material are alternately laminated to each other and expand and contract in an axial direction, can be used, for example. In addition, as the pressure generation unit, an actuator which disposes a heating element in the pressure generation chamber and discharges liquid droplets from the nozzle openings by bubbles generated by the heating of the heating element, or a so-called electrostatic actuator which generates static electricity between the vibrating plate and the electrode, and deforms the vibrating plate by the static electricity to discharge the liquid droplets from the nozzle openings can be used.

Figure 7:
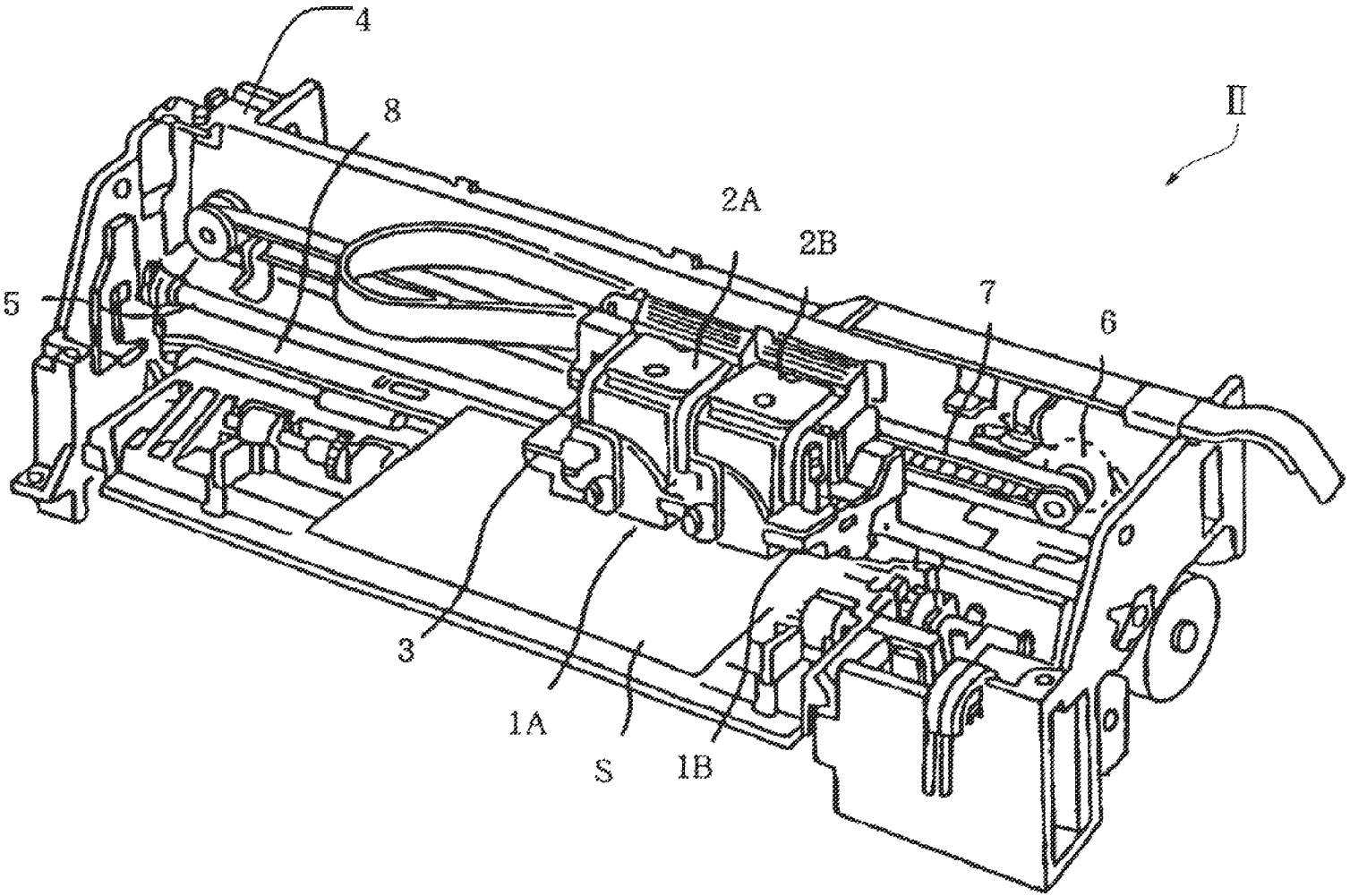
FIG. 7 is a schematic perspective view of a recording apparatus according to one embodiment of the invention.

The ink jet type recording head of each embodiment configures a part of an ink jet recording head unit including an ink flow path communicating with the cartridge and the like, and is loaded on an ink jet type recording apparatus. FIG. 7 is a schematic view showing an example of the ink jet type recording apparatus.

In an ink jet type recording apparatus II shown in FIG. 7, cartridges 2A and 2B configuring the ink supply unit are detachably provided to the ink jet type recording head units 1A and 1B (hereinafter, also referred to as recording head units 1A and 1B) including the plurality of the ink jet type recording heads I, and a carriage 3 on which the head units 1A and 1B are loaded, is movably provided, in an axial direction, on a carriage shaft 5 attached to an apparatus main body 4. For example, the recording head units 1A and 1B discharge a black ink composition and a color ink composition, respectively.

A driving force of a driving motor 6 is transferred to the carriage 3 through a plurality of gear teeth (not shown) and a timing belt 7, and accordingly the carriage 3 on which the recording head units 1A and 1B are loaded is moved along the carriage shaft 5. On the other hand, a platen 8 is provided on the apparatus main body 4 along the carriage shaft 5, and a recording sheet S which is a recording medium such as paper which is fed by a paper feeding roller (not shown) is wound on the platen 8 to be transported.

In the ink jet type recording apparatus II described above, the example in which the ink jet type recording head I (recording head units 1A and 1B) is loaded on the carriage 3 to move in a main scanning direction has been described, however it is not particularly limited thereto, and the invention can also be applied to a so-called line type recording apparatus in which the ink jet type recording head I is fixed and printing is performed by only moving the recording sheet S such as paper in an auxiliary scanning direction.

In addition, in the example described above, the ink jet type recording apparatus II has a configuration in which the cartridges 2A and 2B which are liquid storage units are loaded on the carriage 3, however it is not particularly limited thereto, and for example, the liquid storage unit such as an ink tank may be fixed to the apparatus main body 4, and the storage unit and the ink jet type recording head I may be connected to each other through a supply tube such as tube. In addition, the liquid storage unit may not be loaded on the ink jet type recording apparatus II.

In the embodiments described above, the ink jet type recording head has been described as an example of the liquid ejecting head and the ink jet type recording apparatus has been described as an example of the liquid ejecting apparatus, however, the invention is for general liquid ejecting heads and liquid ejecting apparatuses in a broad sense, and can also be applied to a liquid ejecting head or a liquid ejecting apparatus which ejects liquid other than the ink. As the other liquid ejecting head, various recording heads used in an image recording apparatus such as a printer, a coloring material ejecting head used in manufacturing a color filter such as a liquid crystal display, an electrode material ejecting head used in electrode forming such as an organic EL display or a field emission display (FED), a bioorganic material ejecting head used in bio chip manufacturing, and the like can be exemplified, and the invention can also be applied to a liquid ejecting apparatus including such liquid ejecting heads.

The entire disclosure of Japanese Patent Application No. 2012-284504, filed Dec. 27, 2012 is expressly incorporated by reference herein.

What is claimed is:

1. A liquid ejecting head at least comprising:

a nozzle plate on which nozzle openings for discharging liquid are provided; and a flow path formation substrate on which a pressure generation chamber communicating with the nozzle openings is provided, wherein the nozzle plate is formed with a silicon substrate, and at least the flow path formation substrate and the nozzle plate are bonded to each other after providing a tantalum oxide film formed by atomic layer deposition on the entire surfaces including a bonded surface, wherein the tantalum oxide film includes a first layer having a first portion that continuously covers an inner wall surface of the pressure generation chamber and a second portion that covers a first surface where the flow path formation substrate and the nozzle plate are bonded, and the tantalum oxide film includes a second layer that covers an inner wall of a flow path of the flow path formation substrate and that covers a second surface where the flow path formation substrate and the nozzle plate are bonded.

2. The liquid ejecting head according to claim 1, wherein the tantalum oxide film is formed with a thickness of equal to or greater than 0.3 Å and equal to or smaller than 50 nm.

3. A liquid ejecting apparatus comprising the liquid ejecting head according to claim 2.

4. The liquid ejecting head according to claim 1, further comprising:

a communication plate on which a nozzle communication path for communication of the pressure generation chamber and the nozzle openings is provided, between the flow path formation substrate and the nozzle plate.

5. The liquid ejecting head according to claim 4, wherein the communication plate is formed with a silicon substrate, and the tantalum oxide film is provided on the entire surface including the bonded surface of the communication plate.

6. A liquid ejecting apparatus comprising the liquid ejecting head according to claim 5.

7. A liquid ejecting apparatus comprising the liquid ejecting head according to claim 4.

8. A liquid ejecting apparatus comprising the liquid ejecting head according to claim 1.

* * * * *